US007274885B2

(12) United States Patent
Yokogawa

(10) Patent No.: US 7,274,885 B2
(45) Date of Patent: Sep. 25, 2007

(54) IMAGE FORMING DEVICE HAVING REPLACEABLE DRUM UNIT AND DEVELOPING UNIT

(75) Inventor: Tadahiro Yokogawa, Uji (JP)

(73) Assignee: Murata Machinery, Ltd., Kyoto (JP)

( * ) Notice: Subject to any disclaimer, the term of this patent is extended or adjusted under 35 U.S.C. 154(b) by 156 days.

(21) Appl. No.: 11/232,354

(22) Filed: Sep. 21, 2005

(65) Prior Publication Data

US 2006/0067717 A1 Mar. 30, 2006

(30) Foreign Application Priority Data

Sep. 24, 2004 (JP) ..... 2004-277822

(51) Int. Cl.
*G03G 15/00* (2006.01)
*G03G 21/00* (2006.01)

(52) U.S. Cl. ..... 399/26; 399/27; 399/43

(58) Field of Classification Search ..... 399/26, 399/24, 25, 27, 43, 81, 9, 46
See application file for complete search history.

(56) References Cited

U.S. PATENT DOCUMENTS 5,008,711 A * 4/1991 Sakamoto et al. ..... 399/24
5,021,828 A 6/1991 Yamaguchi et al.
5,548,374 A * 8/1996 Iguchi et al. ..... 399/24
5,572,292 A * 11/1996 Chatani et al. ..... 399/25
5,708,912 A * 1/1998 Lee ..... 399/24
5,850,583 A 12/1998 Song et al.
2001/0055493 A1 12/2001 Asanuma et al.

FOREIGN PATENT DOCUMENTS

EP 0 505 946 A3 9/1992
JP 3-237472 A1 10/1991
JP 04-355464 A * 12/1992
JP 09-006196 A * 1/1997
JP 09-146421 6/1997
JP 2003-098914 4/2003
JP 2003-98914 A1 4/2003

OTHER PUBLICATIONS

Official Communication issued in the British corresponding Patent Application No. GB0517828.0, mailed on Jan. 19, 2006.

* cited by examiner

*Primary Examiner*—Sophia S. Chen
(74) *Attorney, Agent, or Firm*—Keating & Bennett, LLP

(57) ABSTRACT

In an image forming device, when a replacement timing of a photoconductive drum unit has been reached, the image forming device determines whether or not a replacement timing of a developing unit is close, but not yet actually reached. When the replacement timing of the developing unit is close but not yet reached, the image forming device collectively displays a message to urge the user to replace both the photoconductive drum unit and the developing unit at the same time to avoid problems such as a foggy image.

20 Claims, 7 Drawing Sheets

IMAGE FORMING DEVICE HAVING REPLACEABLE DRUM UNIT AND DEVELOPING UNIT

BACKGROUND OF THE INVENTION

1. Field of the Invention

The present invention relates to an image forming device, such as a copying machine, a printer and a facsimile machine.

2. Description of the Related Art

A known electrophotographic image forming device forms an electrostatic latent image by charging and exposing a surface of an image carrier such as a photoconductive drum, visualizes the electrostatic latent image by adhering toner to the electrostatic latent image, and transfers the visualized image onto paper. In such a known image forming device, a replacement timing of each component is set previously. In accordance with a number-of-sheets of paper on which an image is formed or an operation time of the image forming device, a determination is made as to whether or not each component of the imagine forming device has reached a replacement timing, i.e., a time when a component should be replaced. When the replacement timing has been reached, such a fact is displayed to be confirmed by a user.

One conventional device includes a detection display controller, which detects presence or an absence of a periodically replaced component that has reached a duration warning value among each components group that is grouped according to a certain condition. When a component that has reached the duration warning value belongs to a first components group having a shortest duration conversion value, the controller compares a value of a number of times that the first components group is replaced with a value multiplied by an integer relating to a duration conversion value of a second components group. When both values do not correspond with one another, only a replacement instruction of the first components group having the shortest duration conversion value is displayed. When both values correspond with one another, the controller simultaneously displays a replacement instruction of the first components group having the shortest duration conversion value and a replacement instruction of the second components group. Meanwhile, when the periodically replaced component that has reached the duration warning value belongs to the second components group, the controller simultaneously displays the replacement instruction of the second components group and a replacement instruction of the first components group having a duration conversion value shorter than the second components group.

In the above-described conventional device, even when at least one periodically replaced component among a plurality of components groups reaches a replacement warning value, other periodically replaced components may not have reached a duration warning value yet. In such a case, a replacement instruction of such a components group is displayed and all components belonging to such a components group are replaced collectively. Therefore, although a replacement process can be carried out efficiently when the photoconductive drum is replaced with a new photoconductive drum and an image forming process is carried out by using the new photoconductive drum and an old developing unit, which may be close to its replacement timing, the developing unit is influenced by a charging electric potential of the new photoconductive drum. As a result, a deterioration of an image quality, such as a foggy image, is prone to occur.

SUMMARY OF THE INVENTION

In order to overcome the problems described above, preferred embodiments of the present invention provide an image forming device which can prevent a deterioration of an image quality, such as a foggy image, resulting from a difference in replacement timings of a photoconductive drum and a developing unit.

According to a preferred embodiment of the present invention, an image forming device includes a photoconductive drum unit, a developing unit, a first determination unit, a second determination unit, a third determination unit and an announcement display controller. The photoconductive drum unit and the developing unit are replaceable. The first determination unit determines a replacement timing of the photoconductive drum unit, that is, a time when the photoconductive drum unit should be replaced. The second determination unit determines a replacement timing of the developing unit in accordance with usage performance data of the developing unit, that is, a time when the developing unit should be replaced based on the amount of its use. When the first determination unit determines that the replacement timing of the photoconductive drum unit has been reached, the third determination unit determines whether or not the usage performance data of the developing unit is within a prescribed value that is close to, but not yet at, the replacement timing. When the third determination unit determines that the usage performance data of the developing unit is within a prescribed value of the replacement timing, the announcement display controller displays an announcement of a replacement timing of the photoconductive drum unit and the developing unit in accordance with a determination result of the second determination unit. Further, the usage performance data of the developing unit is preferably a number-of-sheets executed or printed via an image forming process.

According to the above described preferred embodiment, when the first determination unit determines that the photoconductive drum unit has reached the replacement timing, the third determination unit determines whether or not the developing unit is close to, but not yet at the replacement timing. When the third determination unit determines that the replacement timing is close, the announcement display controller displays the announcement of the replacement timing of both the photoconductive drum unit and the developing unit in accordance with the determination result of the second determination unit. Therefore, the announcement display controller can urge the user to replace both the photoconductive drum unit and the developing unit at the same time. When the user replaces the photoconductive drum unit and the developing unit at the same time, it is possible to prevent a deterioration of an image, such as a foggy image, that is generated when only the photoconductive drum is replaced.

Further, since the photoconductive drum deteriorates gradually, there is a range in the replacement timing of the photoconductive drum. Even when a predetermined replacement timing elapses, the image quality does not deteriorate drastically. When the replacement timing of the photoconductive drum is reached and the replacement timing of the developing unit is close but not yet at its replacement timing, replacing the photoconductive drum in accordance with the replacement timing of the developing unit results in both the photoconductive drum and the developing unit becoming new. As a result, a high image quality can be achieved in the same manner as a default setting.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described below. Further, the preferred embodiments to be described below are only preferred specific examples for implementing the present invention. Therefore, there are various technical limitations in the following description. However, unless explicitly stated in the following description, the present invention shall not be limited to the preferred embodiments described herein.

Figure 1:
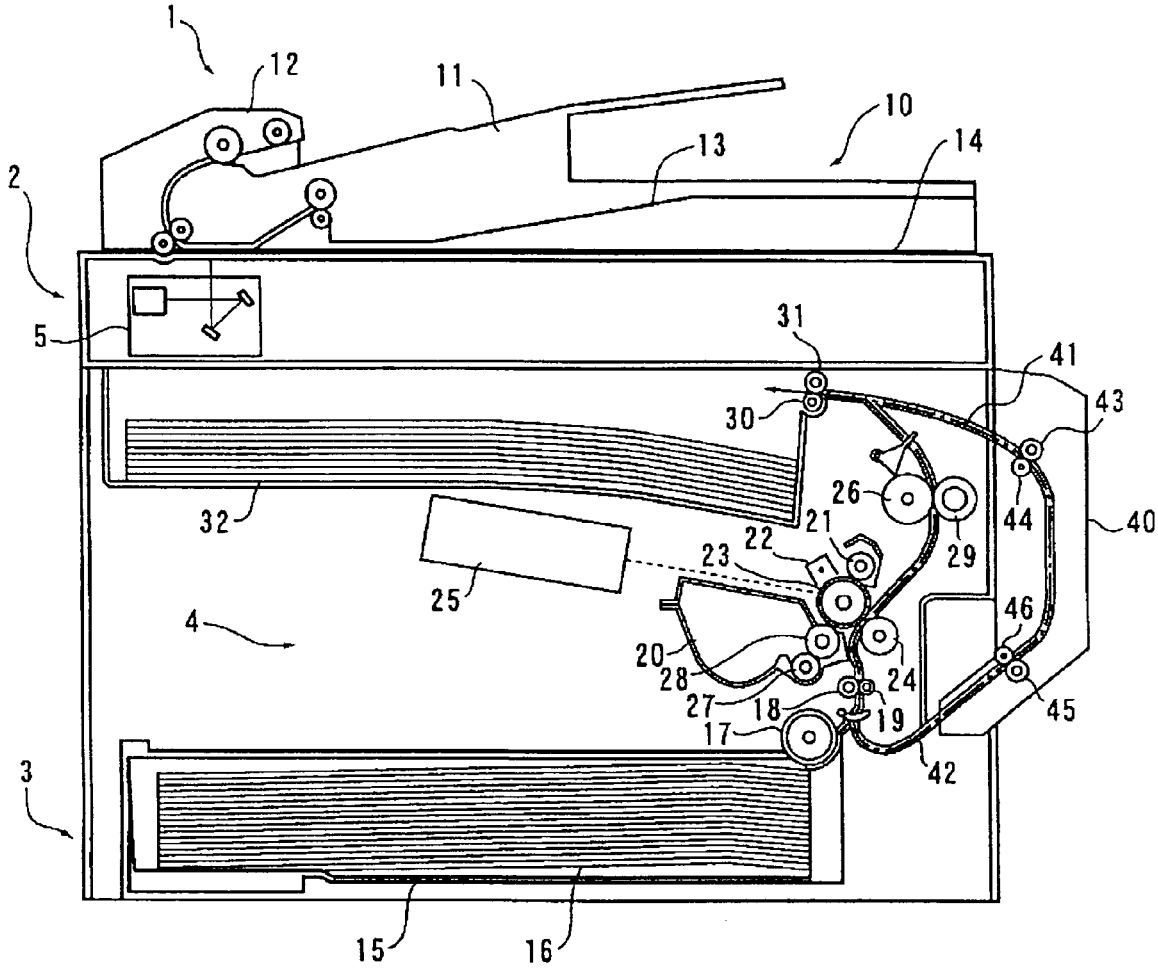
FIG. 1 is a schematic cross-sectional view showing the entire image forming device according to a preferred embodiment of the present invention.

FIG. 1 is a schematic cross-sectional view showing the entire image forming device 1 according to a preferred embodiment of the present invention. A document scanning unit 2 is disposed in an upper portion of the image forming device 1. A paper feed unit 3 and a printer unit 4 are disposed in a lower portion of the image forming device 1, in this order, from a bottom side of the image forming device 1.

In the document scanning unit 2, an original document is stacked on a document tray 11 provided on a document cover 10. The stacked original document is transported to a position facing a scanner unit 5 by a document transportation device 12, and a scanning process of the original document is carried out at that position. Then, the original document is discharged onto a document discharge tray 13. When scanning a booklet or the like, the document cover 10 is swung upward. A portion of the booklet or the like to be scanned is placed on a flat bed platen 14, and a scanning process is carried out by the scanner unit. The above-described structure is the same as a conventional document scanning device known as an Automatic Document Feeder (ADF) and a flat bed type.

A paper feed cassette 15 is disposed in the paper feed unit 3. A plurality of sheets of paper of a prescribed size are stacked on a flapper 16. A pickup roller 17 is disposed at an end (a right-side end in FIG. 1) of the paper feed cassette 15. The flapper 16 is urged upward so that an upper surface of the stacked papers makes contact with the pickup roller 17. When the pickup roller 17 is driven and rotated under this state, the papers are fed into a paper transportation path one sheet at a time by frictional force.

The fed paper is transported to the printer unit 4 by a feed roller 18 and a press roller 19. For printing onto the transported paper, the printer unit 4 includes a developing unit 20, a rotating brush 21, a charging unit 22, a photoconductive drum 23, a transfer roller 24, an exposing device 25 and a fixing roller 26.

The photoconductive drum 23 is cylindrically shaped and a photoconductive layer having a prescribed thickness is provided on an outer circumferential surface of the photoconductive drum 23. The photoconductive drum 23 is driven and rotated by a main motor 56 (see FIG. 3). A toner image is formed on a surface of the photoconductive drum 23 by the charging unit 22, the exposing device 25 and the developing unit 20. The charging unit 22 uniformly charges the surface of the photoconductive drum 23 by a corona charge from a discharge wire. The photoconductive drum 23 is unitized and capable of being removed. When the photoconductive drum 23 deteriorates and an image quality deteriorates, the entire unit is required to be replaced with a new photoconductive drum unit.

The exposing device 25 irradiates light on the outer circumferential surface of the photoconductive drum 23 in accordance with input image information. An electrostatic latent image corresponding to the image information is formed on the outer circumferential surface of the photoconductive drum 23. Toner is accumulated inside the developing unit 20. When the toner is consumed, the developing unit 20 is replaced with a new developing unit without replenishing toner in the original developing unit. The toner is transferred onto the surface of the photoconductive drum 23 by a supply roller 27 and a developing roller 28 mounted on the developing unit 20. Accordingly, the electrostatic latent image formed on the surface of the photoconductive drum 23 is visualized. A developing voltage is applied to the developing roller 28. According to a potential difference between a charge of the surface of the photoconductive drum 23 and the developing voltage, the toner adhered on a surface of the developing roller 28 is transferred onto the photoconductive drum 23, and a toner image is formed.

A transfer voltage is applied to the transfer roller 24. The toner image developed on the surface of the photoconductive drum 23 moves by an electric field attraction force that is generated by the applied transfer voltage. That is, when paper exists between the photoconductive drum 23 and the transfer roller 24, the toner is transferred onto the paper. When paper does not exist between the photoconductive drum 23 and the transfer roller 24, the transfer roller 24 makes contact with the surface of the photoconductive drum 23. A charge removing brush (not shown) removes an electric charge from the toner transferred onto the paper.

The rotating brush 21 is provided downstream of the transfer roller 24. The rotating brush 21 makes contact with the surface of the photoconductive drum 23 to remove paper dusts adhered on the surface of the photoconductive drum 23 or to scatter the toner remaining on the surface of the photoconductive drum 23 without being transferred. Further, since a constant voltage is applied to the rotating brush 21, the remaining toner scatters efficiently.

The transferred toner image is held by a fixing roller 26 and a press roller 29. Heat and pressure are applied to the toner image, and the toner image is fixed onto the paper. A heater lamp is provided inside the fixing roller 26. The heater lamp generates heat and the fixing roller 26 is heated. The paper on which the toner image is fixed is held between a paper discharge roller 30 and a press roller 31 and transported out onto a paper discharge tray 32.

A paper transportation path is illustrated in FIG. 1 with a dashed line from the paper feed unit 3 to the paper discharge tray 32. A reversal transportation unit 40 is removably inserted in a side of a main body of the image forming device 1. A paper transportation outlet 41 and a paper transportation inlet 42 are formed at the side where the reversal transportation unit 40 is inserted. Two pairs of transportation rollers, i.e., a feed roller 43 and a press roller 44, and a feed roller 45 and a press roller 46, are disposed vertically in the reversal transportation unit 40. A reversal transportation path shown with a dashed line in FIG. 1 is arranged to diverge from the paper transportation path between the paper discharge roller 30 and the fixing roller 26, to pass through the two pairs of transportation rollers 43 and 44, and 45 and 46, and to join the paper transportation path between the roller pair 18 and 19 and the pickup roller 17.

Figure 2:
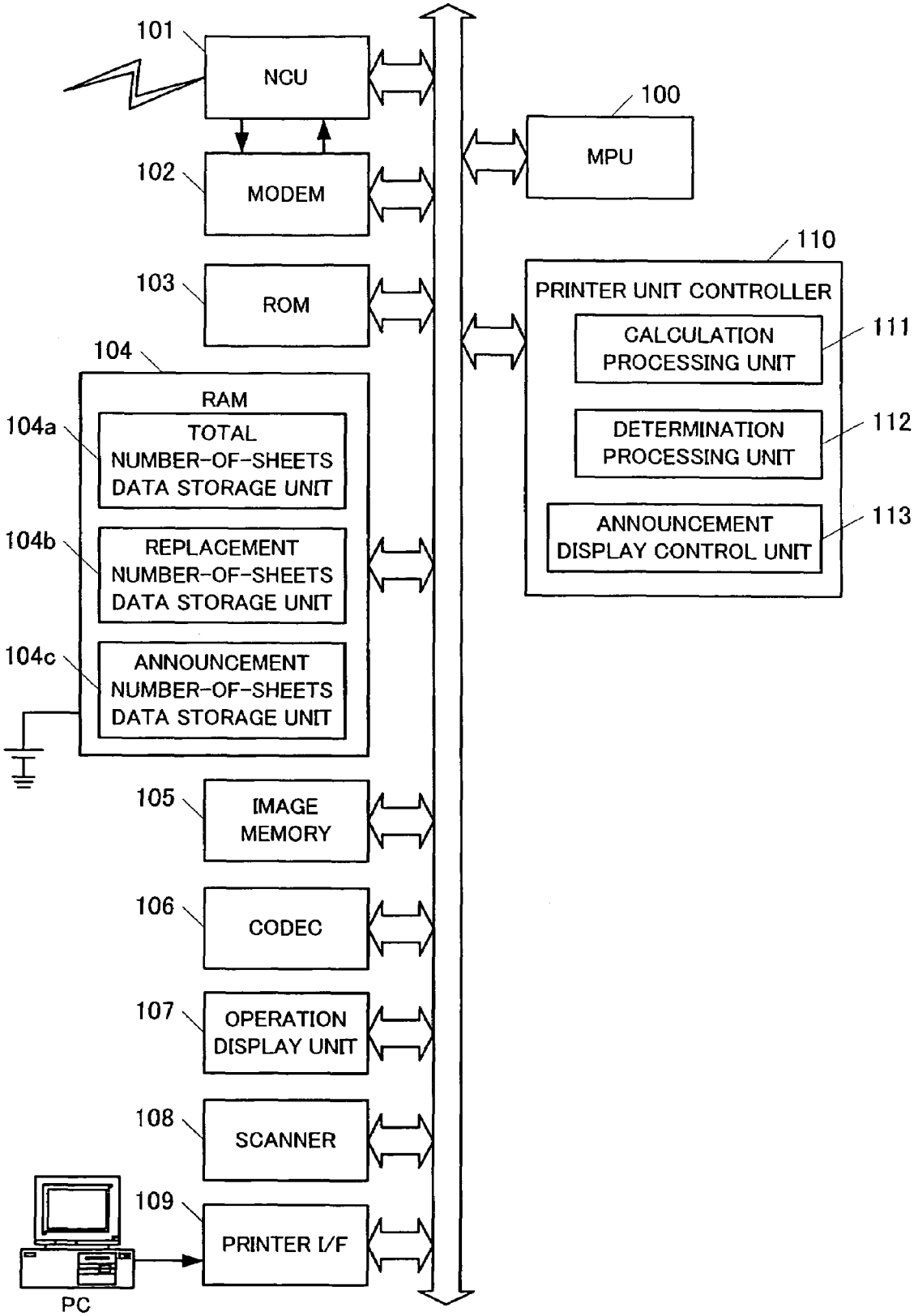
FIG. 2 is an entire block diagram relating to a preferred embodiment of the present invention.

FIG. 2 is a block diagram showing the entire image forming device 1. In the present preferred embodiment, the image forming device 1 preferably has a facsimile function and a copying function, for example. Specifically, the image forming device 1 includes a Micro Process Unit (MPU) 100, a Network Control Unit (NCU) 101, a modem 102, a Read Only Memory (ROM) 103, a Random Access Memory (RAM) 104, an image memory 105, a codec 106, an operation display unit 107, a scanner 108 and a printer interface 109. The MPU 100 is a control unit. The NCU 101 controls communication with a network. The modem 102 controls facsimile communication. The ROM 103 stores a program or the like. The RAM 104 stores data or the like. The image memory 105 stores received or scanned image information. The codec 106 encodes or decodes image information. The operation display unit 107 carries out a display for an operation input. In addition, the operation display unit 107 carries out an announcement display such as notice and warning of a replacement timing of each component. The scanner 108 scans image information. The printer interface 109 receives a print command from a remote computer (PC) or the like. Each of functional blocks 100 through 109 is connected to one another via a data bus and an address bus. The entire image forming device 1 is controlled by the MPU 100. Information received by facsimile, information scanned by a scanner, and information received along with a print command are transmitted to a printer unit controller 110, and an image is formed on paper.

The RAM 104 includes a total number-of-sheets data storage unit 104*a*, a replacement number-of-sheets data storage unit 104*b* and an announcement number-of-sheets data storage unit 104*c*. The total number-of-sheets data storage unit 104*a* stores total number-of-sheets data, which is a total number of sheets of papers executed with an image forming process. The replacement number-of-sheets data storage unit 104*b* stores the total number-of-sheets data as the replacement number-of-sheets data at the replacement time of the photoconductive drum unit and/or the developing unit. The announcement number-of-sheets data storage unit 104*c* stores both the notice number-of-sheets data and the warning number-of-sheets data of the photoconductive drum unit and the developing unit. The total number-of-sheets data is data that has counted a print command for each sheet of paper at the printer unit controller 110. The total number-of-sheets data indicates a total printed number of sheets executed with the image forming process. The replacement number-of-sheets data is the total number-of-sheets data at the replacement time of the photoconductive drum unit and/or the developing unit. By subtracting the replacement number-of-sheets data from the current total number-of-sheets data, a printed number-of-sheets counted from the time of replacement can be obtained. This printed number of sheets corresponds to the usage performance data of the photoconductive drum unit and/or the developing unit. The notice number-of-sheets data and the warning number-of-sheets data for the photoconductive drum are the predetermined printed number-of-sheets when the photoconductive drum deteriorates after repeating the image forming process and reaching the replacement timing. The notice number-of-sheets data and the warning number-of-sheets data for the developing unit are the predetermined printed number-of-sheets when the remaining amount of the toner in the developing unit becomes low and the developing unit reaches the replacement timing. Thus, the notice number-of-sheets data is a predetermined printed number-of-sheets when the photoconductive drum unit or the developing unit becomes worn and should be replaced. The warning number-of-sheets data is a predetermined numeric value, which is calculated by adding a prescribed number-of-sheets to the notice number-of-sheets data. The warning number-of-sheets data is set considering the case where an image quality will deteriorate considerably if the developing unit is used beyond the set numeric value. Further, a power source is supplied to the RAM 104 at all times to prevent a memory from being erased when the power source is cut.

In general, the photoconductive drum deteriorates at a slower speed than a speed at which the toner amount in the developing unit decreases. Therefore, the notice number-of-sheets data (for example, 30,000 sheets) of the photoconductive drum unit is preferably greater than the notice number-of-sheets data (for example, 5,000 sheets) of the developing unit.

The printer unit controller 110 includes a calculation processing unit 111, a determination processing unit 112 and an announcement display control unit 113. The calculation processing unit 111 carries out processes such as a counting process of the total number-of-sheets data and a calculation process of the usage performance data. The determination processing unit 112 carries out a determination process of the replacement timing or the like of each member. The announcement display control unit 113 displays announcement information on the operation display unit 107.

Figure 3:
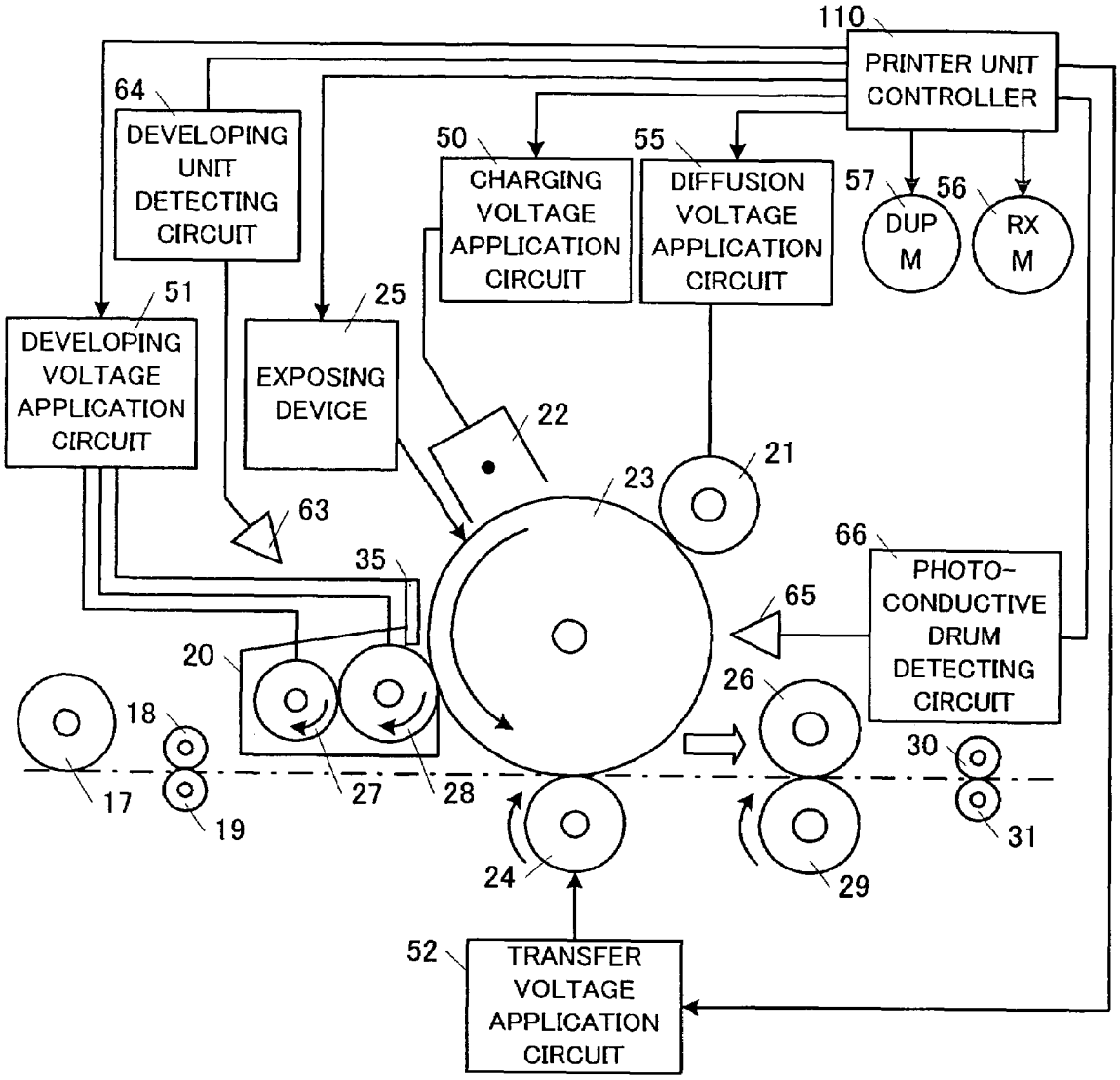
FIG. 3 is a block diagram showing a circuit configuration of a printer unit.

FIG. 3 is a schematic diagram showing a circuit configuration of the printer unit 4. As described above, the charging unit 22, the exposing device 25, the developing unit 20, the transfer roller 24 and the rotating brush 21 are arranged around the photoconductive drum 23, in this order, along the rotational direction of the photoconductive drum 23.

A charging voltage application circuit 50 is connected to the charging unit 22. The charging voltage application circuit 50 applies a charging voltage to the charging unit 22. A print signal based on image information is transmitted from the printer unit controller 110 to the exposing device 25. The exposing device 25 irradiates light on the surface of the photoconductive drum 23. A portion of the uniformly charged surface of the photoconductive drum 23 is exposed and an electrostatic latent image according to the image information is formed.

A developing voltage application circuit 51 is connected to the supply roller 27, the developing roller 28 and a blade 35 in the developing unit 20. In accordance with a control signal from the printer unit controller 110, the developing voltage application circuit 51 applies voltage to each of the members 27, 28 and 35. The toner adheres evenly on the electrostatic latent image formed on the surface of the photoconductive drum 23 and the electrostatic latent image is visualized. A transfer voltage application circuit 52 is connected to the transfer roller 24. In accordance with a control signal from the printer unit controller 110, the transfer voltage application circuit 52 applies a transfer voltage to the transfer roller 24. The toner image formed on the surface of the photoconductive drum 23 is transferred onto paper by electric field attraction force. A diffusion voltage application circuit 55 is connected to the rotating brush 21. In accordance with a control signal from the printer unit controller 110, the diffusion voltage application circuit 55 applies a diffusion voltage to the rotating brush 21. The toner remaining on the surface of the photoconductive drum 23 is diffused efficiently.

The printer unit controller 110 transmits a control signal to the main motor 56 and a sub motor 57, and controls the main motor 56 and the sub motor 57. In accordance with the control signal from the printer unit controller 110, the main motor 56 drives and rotates the pickup roller 17, the feed roller 18, the rotating brush 21, the photoconductive drum 23, the supply roller 27, the developing roller 28, the fixing roller 26 and the press roller 29. The paper discharge roller 30 is rotated in a direction to discharge the paper via a clutch by a rotational driving force from the main motor 56. In accordance with the control signal from the printer unit controller 110, the sub motor 57 drives and rotates the feed rollers 43 and 45, and drives and rotates the paper discharge roller 30 via the clutch in a direction to reverse the paper.

A detecting sensor 63 for detecting a replacement of the developing unit 20 is provided near the developing unit 20 in the main body of the image forming device 1. When the developing unit is replaced and a new developing unit is inserted, a detection signal is output from the detection sensor 63 to a developing unit detecting circuit 64 and transmitted to the printer unit controller 110. A detecting sensor 65 for detecting a replacement of the photoconductive drum unit is disposed near the photoconductive drum 23. In the same manner as the detecting sensor 63, when the photoconductive drum unit is replaced and a new photoconductive drum unit is inserted, a detection signal is output from the detecting sensor 65 to a photoconductive drum detecting circuit 66 and transmitted to the printer unit controller 110.

Figure 4:
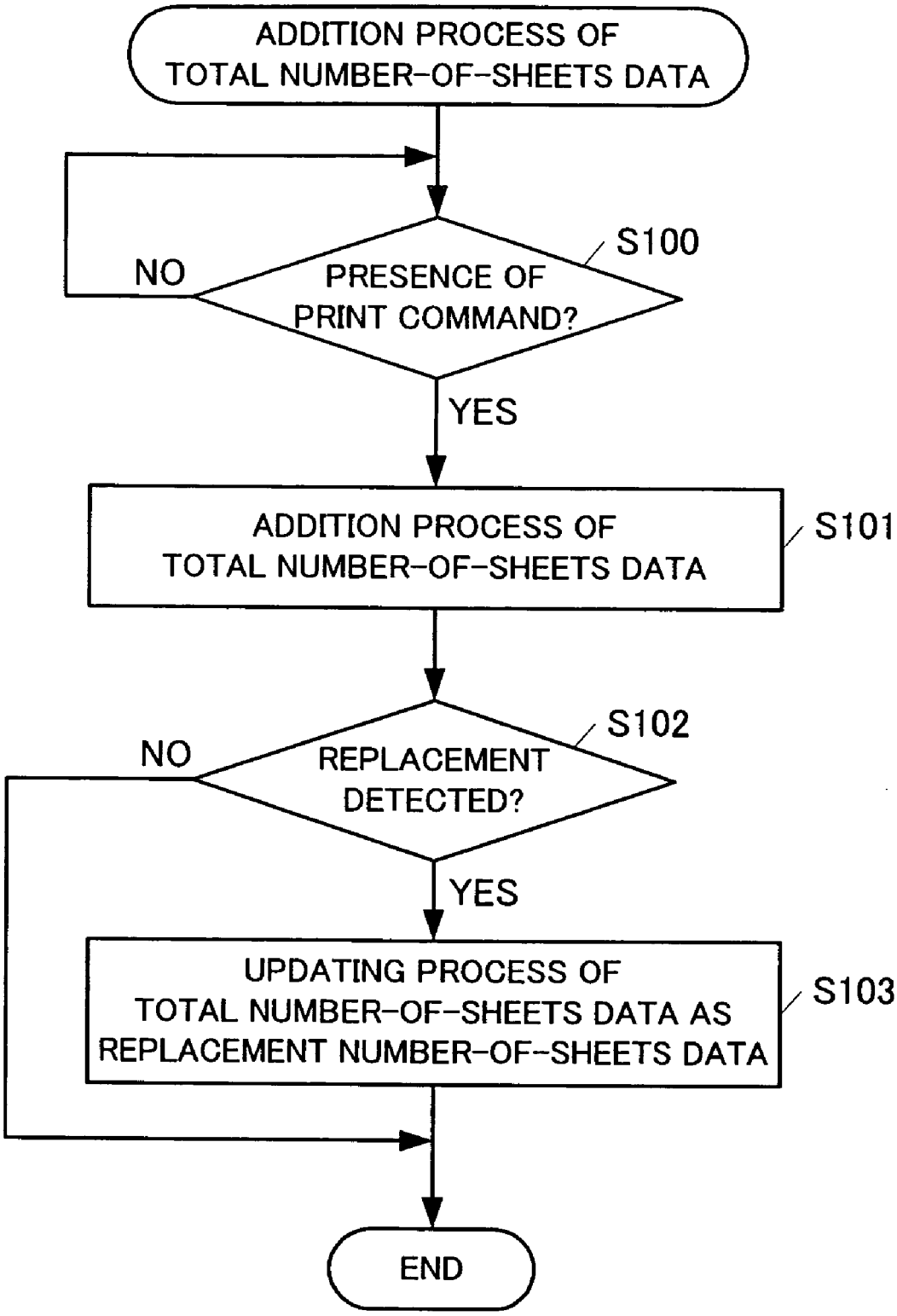
FIG. 4 is a flowchart showing an addition process of total number-of-sheets data.

Next, a description will be made of an announcement display of the replacement timing of the photoconductive drum unit and the developing unit. FIG. 4 is a flowchart showing an addition process of the total number-of-sheets data. The printer unit controller 110 checks whether or not a print command for one sheet of paper has been output (step S100). When a print command has been output, an addition process of the total number-of-sheets data is carried out (step S101). In the addition process, the total number-of-sheets data is retrieved from the total number-of-sheets data storage unit 104*a*, a process for adding "1" is carried out by the calculation processing unit 111, and the data stored in the total number-of-sheets data storage unit 104*a* is updated. Then, a determination is made as to whether or not a detection signal has been transmitted from the developing unit detecting circuit 64 or the photoconductive drum detecting circuit 66. In other words, a determination is made as to whether or not the developing unit or the photoconductive drum has been replaced (step S102). When a detection signal has been transmitted, the replacement number-of-sheets data of the member transmitted with the detection signal is updated (step S103), and the process ends. In the updating process, for example, when the detection signal is transmitted from the developing unit detecting circuit 64, the total number-of-sheets data stored in the total number-of-sheets data storage unit 104*a* is retrieved, and the replacement number-of-sheets data of the developing unit stored in the replacement number-of-sheets data storage unit 104*b* is updated with the retrieved total number-of-sheets data and stored. The same description applies also to the photoconductive drum unit. Therefore, the total number-of-sheets data at the replacement time of the currently inserted photoconductive drum unit and the developing unit are stored in the replacement number-of-sheets data storage unit 104*b* as the replacement number-of-sheets data.

When a detection signal is not transmitted from the developing unit detecting circuit 64 or the photoconductive drum detecting circuit 66 at step S102, the process ends.

Figure 5:
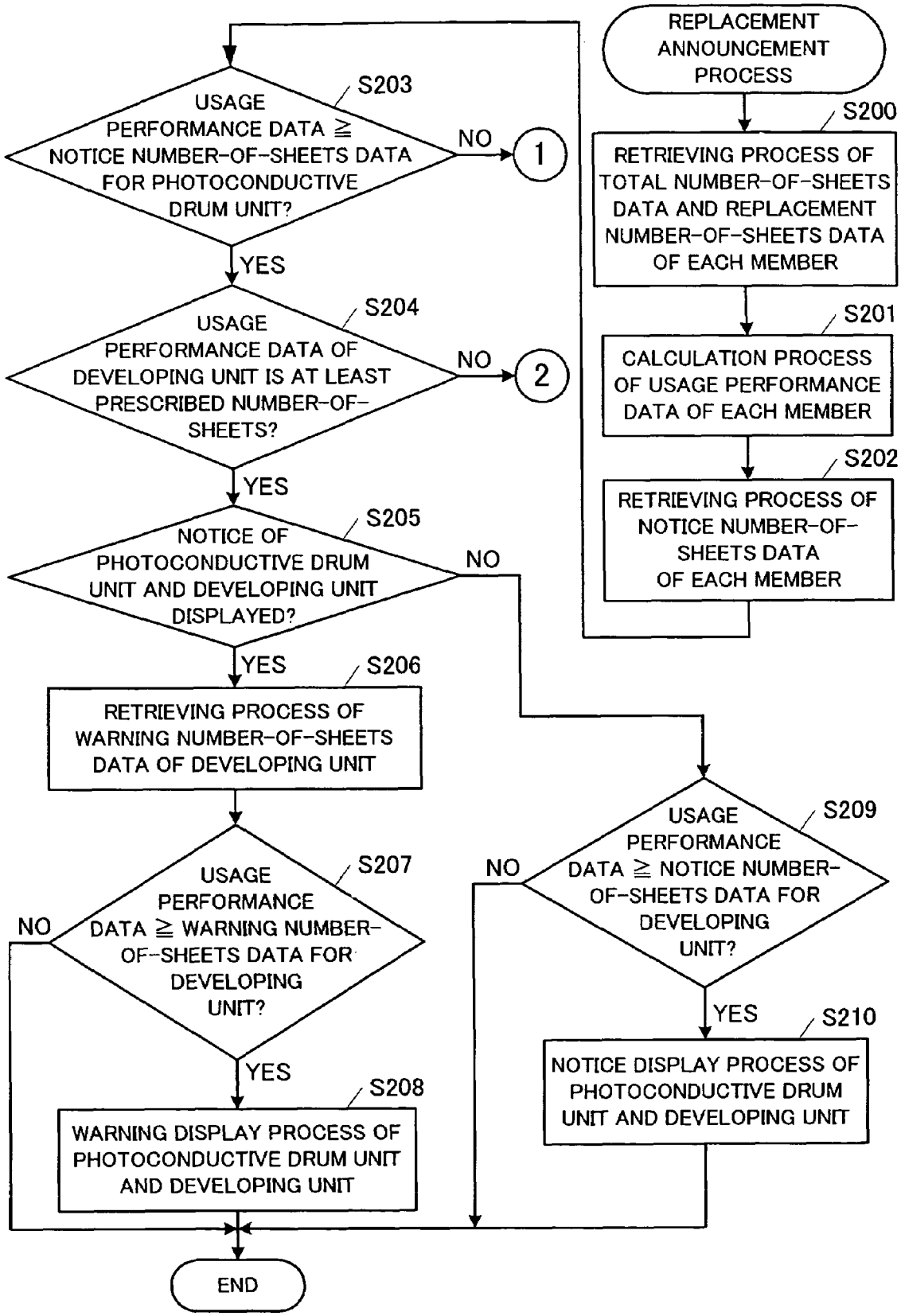
FIG. 5 is a flowchart showing a replacement announcement process.
Figure 6:
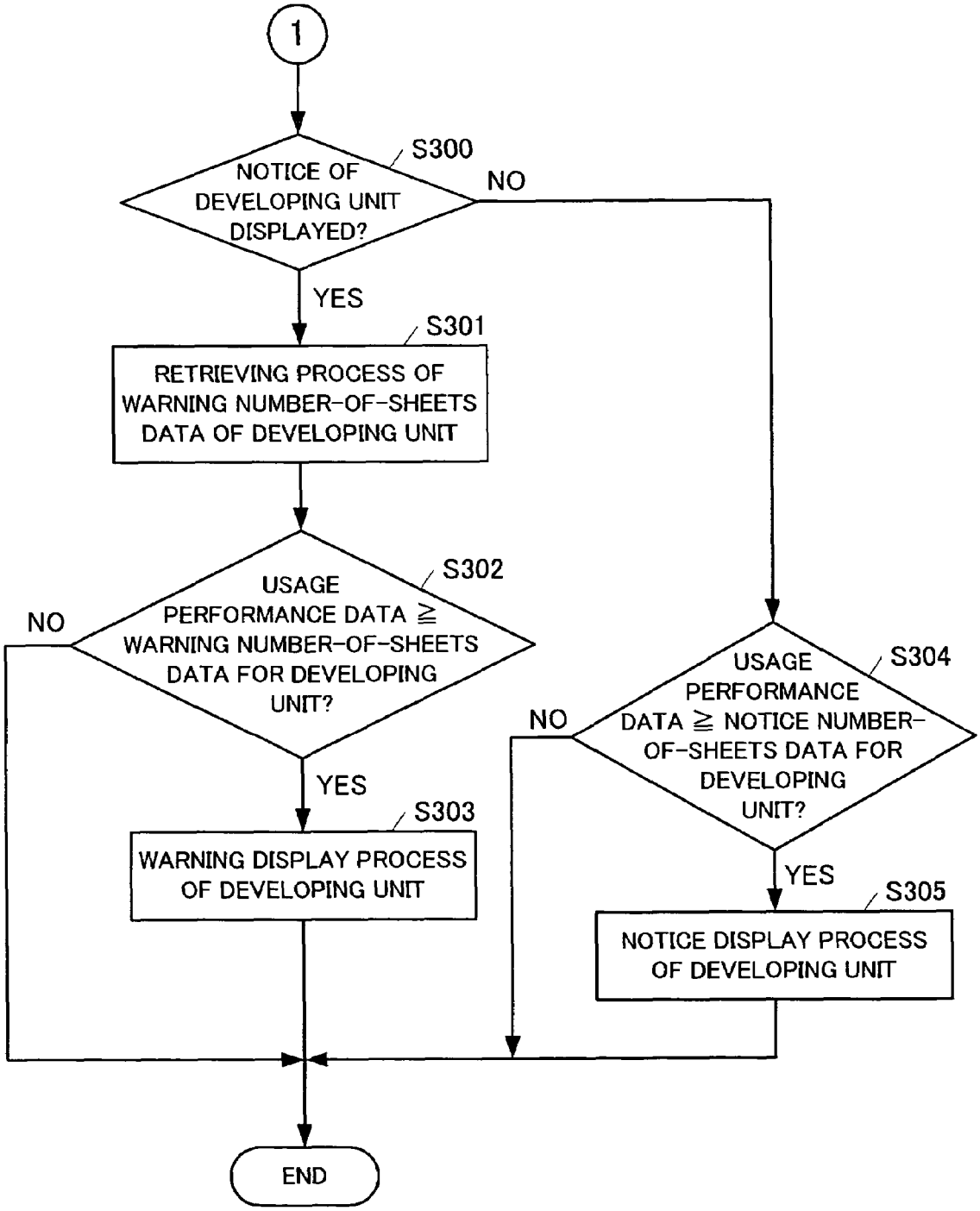
FIG. 6 is a flowchart showing a replacement announcement process.
Figure 7:
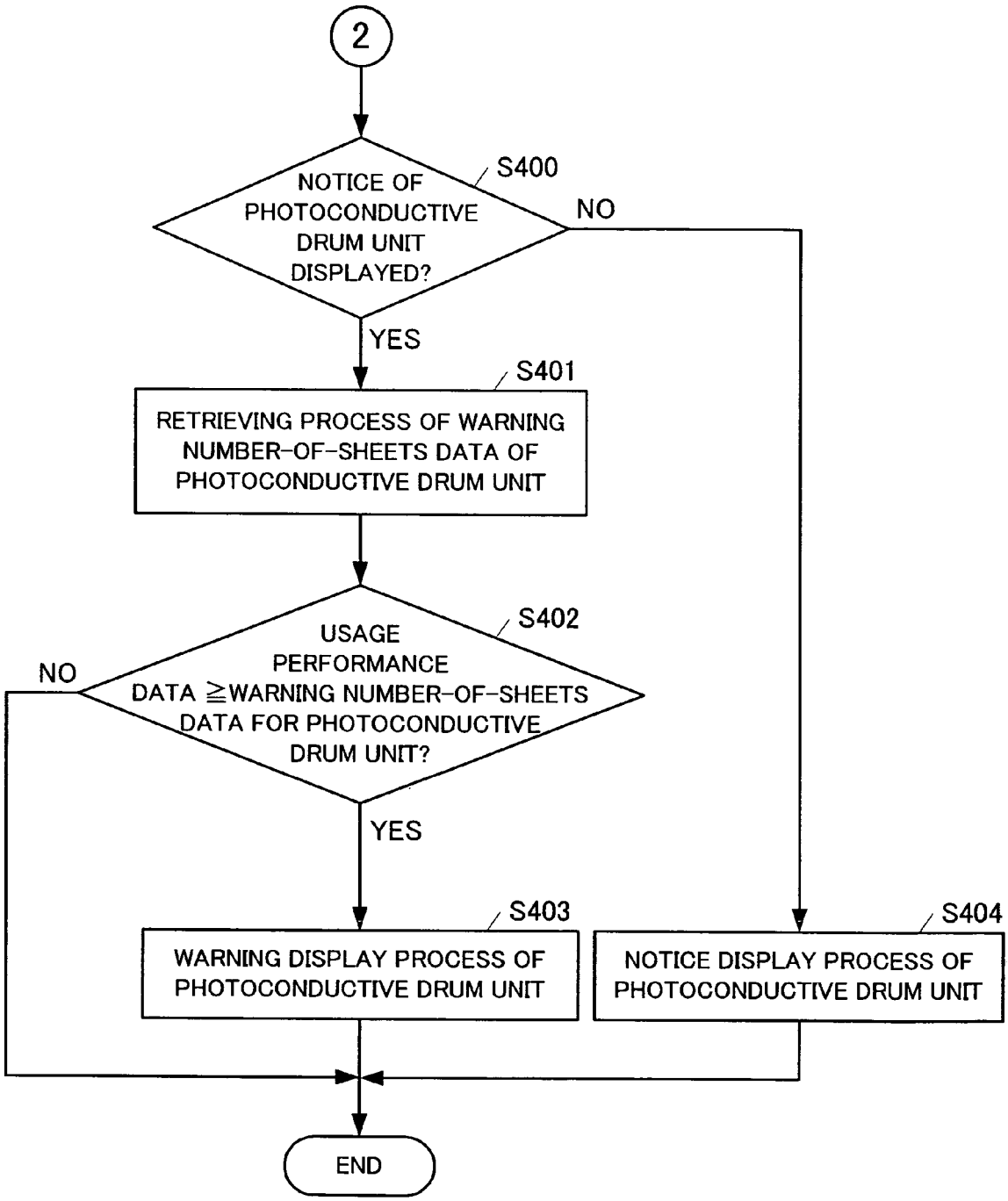
FIG. 7 is a flowchart showing a replacement announcement process.

FIG. 5 through FIG. 7 are flowcharts relating to the announcement process of the replacement timing of the photoconductive drum unit and the developing unit. First, the total number-of-sheets data stored in the total number-of-sheets data storage unit 104*a* and the replacement number-of-sheets data of the photoconductive drum unit and the developing unit stored in the replacement number-of-sheets data storage unit 104*b* are retrieved (step S200). Then, a calculation process of the usage performance data of the photoconductive drum unit and the developing unit is carried out (step S201). In the calculation process, the usage performance data of the developing unit is obtained by subtracting the replacement number-of-sheets data of the developing unit from the retrieved total number-of-sheets data. In the same manner, the usage performance data of the photoconductive drum unit is obtained by subtracting the replacement number-of-sheets data of the photoconductive drum unit from the retrieved total number-of-sheets data.

Next, the predetermined notice number-of-sheets data of the photoconductive drum unit and the developing unit stored in the announcement number-of-sheets data storage unit 104*c* are retrieved (step S202). First, a determination is made as to whether or not the usage performance data for the photoconductive drum unit is at least the notice number-of-sheets data (step S203) to determine whether or not the photoconductive drum unit has reached the replacement timing. When a determination is made at step S203 that the usage performance data is at least the notice number-of-sheets data, a determination is made as to whether or not the usage performance data of the developing unit is at least a prescribed number-of-sheets (step S204). At step S204, a value that is suitably close to the notice number-of-sheets data is set as a prescribed number-of-sheets, and a determination is made as to whether or not the replacement timing of the developing unit has been approached, but not reached. When a determination is made that the replacement timing of the developing unit is close but not yet reached, a determination is made as to whether or not a notice is displayed for urging a replacement of the photoconductive drum unit and the developing unit (step S205). When a notice is already displayed, predetermined warning number-of-sheets data of the developing unit stored in the announcement number-of-sheets data storage unit 104*c* is retrieved (step S206). Then, a determination is made as to whether or not the usage performance data for the developing unit is at least the warning number-of-sheets data (step S207). When a determination is made that the usage performance data is at least the warning number-of-sheets data, a warning display process is carried out for switching the replacement notice display of the photoconductive drum unit and the developing unit to a warning display (step S208). When a determination is made that the usage performance data of the developing unit is smaller than the warning number-of-sheets data, the process ends.

When a determination is made at step S205 that a notice is not displayed, a determination is made as to whether or not the usage performance data for the developing unit is at least the notice number-of-sheets data (step S209) to determine whether or not the developing unit has reached the replacement timing. When a determination is made that the usage performance data is at least the notice number-of-sheets data, a replacement notice display process of the photoconductive drum unit and the developing unit is carried out (step S210). When a determination is made that the usage performance data of the developing unit is smaller than the notice number-of-sheets data, the process ends.

When a determination is made at step S203 that the usage performance data for the photoconductive drum unit is smaller than the notice number-of-sheets data, the process proceeds to step S300 of FIG. 6. At step S300, a determination is made as to whether or not a notice urging a replacement of the developing unit is displayed. When a notice is already displayed, the warning number-of-sheets data of the developing unit stored in the announcement number-of-sheets data storage unit 104*c* is retrieved (step S301) Then, a determination is made as to whether or not the usage performance data for the developing unit is at least the warning number-of-sheets data (step S302). When a determination is made that the usage performance data is at least the warning number-of-sheets data, a warning display process is carried out for switching the replacement notice display of the developing unit to the warning display (step S303). When a determination is made that the usage performance data of the developing unit is smaller than the warning number-of-sheets data, the process ends.

When a determination is made at step S300 that a notice is not displayed, a determination is made as to whether or not the usage performance data for the developing unit is at least the notice number-of-sheets data (step S304) to determine whether or not the developing unit has reached the replacement timing. When a determination is made that the usage performance data is at least the notice number-of-sheets data, a replacement notice display process of the developing unit is carried out (step S305). When a determination is made that the usage performance data of the developing unit is smaller than the notice number-of-sheets data, the process ends.

When a determination is made at step S204 that the usage performance data of the developing unit is smaller than a prescribed number-of-sheets, the process proceeds to step S400 of FIG. 7. At step S400, a determination is made as to whether or not a notice urging a replacement of the photoconductive drum unit is displayed. When the notice is already displayed, the warning number-of-sheets data of the photoconductive drum unit stored in the announcement number-of-sheets data storage unit 104*c* is retrieved (step S401). Then, a determination is made as to whether or not the usage performance data for the photoconductive drum unit is at least the warning number-of-sheets data (step S402). When a determination is made that the usage performance data is at least the warning number-of-sheets data, a warning display process is carried out for switching the replacement notice display of the photoconductive drum unit to the warning display (step S403). When a determination is made that the usage performance data of the photoconductive drum unit is smaller than the warning number-of-sheets data, the process ends.

When a determination is made at step S400 that a notice is not displayed, a replacement notice display process of the photoconductive drum unit is carried out (step S404), and the process ends.

By periodically carrying out the replacement notice process as described above, when the photoconductive drum unit has reached the replacement timing, a determination can be made as to whether or not the replacement timing of the developing unit is close but not yet reached. When the replacement timing of the developing unit is close but not yet actually reached, a replacement notice display process and a warning display process of the photoconductive drum unit and the developing unit can be carried out together. Therefore, it is possible to urge the user to replace both the photoconductive drum unit and the developing unit together. As a result, it is possible to prevent a deterioration of an image quality, such as a foggy image, resulting from the usage of a newly replaced photoconductive drum unit along with an old developing unit. In addition, the replacement notice display process and the warning display process of both the photoconductive drum unit and the developing unit are carried out after determining whether or not the developing unit has reached the replacement timing. Therefore, it is possible to urge the user to replace the photoconductive drum unit in accordance with the replacement timing of the developing unit. As a result, the replacement timing of the photoconductive drum unit, which deteriorates slowly, can be delayed, and the disadvantages resulting from having simultaneous replacement timings can be minimized.

In the above-described preferred embodiment, a determination as to the replacement timing of the photoconductive drum unit and the developing unit is carried out in accordance with a printed number-of-sheets. However, the determination can be carried out in accordance with an operation time of each of the photoconductive drum unit and the developing unit. The determination of the replacement timing of the photoconductive drum unit can be carried out by detecting a deterioration of the surface of the photoconductive drum by a sensor.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

What is claimed is:

1. An image forming device, comprising:

a replaceable photoconductive drum unit;

a replaceable developing unit; and a controller, which includes:

a first determination processing unit, which determines whether or not the photoconductive drum unit has reached a replacement timing;

a second determination processing unit, which determines a replacement timing of the developing unit in accordance with usage performance data of the developing unit;

a third determination processing unit, which determines whether or not the developing unit is within a prescribed value of the replacement timing of the developing unit but has not yet reached the replacement timing of the developing unit, when the first determination processing unit determines that the replacement timing of the photoconductive drum unit has been reached; and a display control unit, which displays an announcement of the replacement timing of the photoconductive drum unit and the developing unit in accordance with a determination result of the second determination processing unit, when the third determination processing unit determines that the usage performance data of the developing unit is within the prescribed value.

2. The image forming device according to claim 1, wherein when the first determination processing unit determines that the replacement timing of the photoconductive drum unit has been reached and the second determination processing unit determines that the replacement timing of the developing unit is within the prescribed value but has not yet reached the replacement timing of the developing unit, then the display control unit displays a replacement announcement of the photoconductive drum unit and the developing unit.

3. The image forming device according to claim 1, further comprising a storage unit arranged to store data, wherein the storage unit includes a total number-of-sheets data storage unit arranged to store total number-of-sheets data which represents a total number of sheets of paper on which an image forming process has been executed, a replacement number-of-sheets data storage unit arranged to store the total number-of-sheets data as replacement number-of-sheets data at a time of replacement of the photoconductive drum unit, and a notice number-of-sheets data storage unit arranged to store notice number-of-sheets data which represents a predetermined printed number-of-sheets when the photoconductive drum unit should be replaced.

4. The image forming device according to claim 3, wherein the first determination processing unit calculates usage performance data of the photoconductive drum unit by subtracting the replacement number-of-sheets data of the photoconductive drum unit from the total number-of-sheets data, and determines the replacement timing of the photoconductive drum unit by determining whether or not the usage performance data of the photoconductive drum unit is at least the notice number-of-sheets data of the photoconductive drum unit.

5. The image forming device according to claim 3, wherein the replacement number-of-sheets data storage unit is arranged to store a total number-of-sheets data at a time of replacement of the developing unit as replacement number-of-sheets data of the developing unit, and the notice number-of-sheets data storage unit is arranged to store notice number-of-sheets data of the developing unit which represents a predetermined printed number-of-sheets when the developing unit should be replaced.

6. The image forming device according to claim 5, wherein the second determination processing unit calculates usage performance data of the developing unit by subtracting the replacement number-of-sheets data of the developing unit from the total number-of-sheets data, and determines the replacement timing of the developing unit by determining whether or not the calculated usage performance data is at least the notice number-of-sheets data of the developing unit.

7. The image forming device according to claim 5, wherein the notice number-of-sheets data of the photoconductive drum unit is greater than the notice number-of-sheets data of the developing unit.

8. The image forming device according to claim 3, wherein each time a print command for one sheet of paper is output, the controller updates the total number-of-sheets data by adding 1 to the total number-of-sheets data.

9. The image forming device according to claim 3, further comprising a detecting sensor arranged to detect a replacement of the photoconductive drum unit, and a photoconductive drum detecting circuit which transmits a detection signal from the detecting sensor to the controller, wherein when the detection signal from the photoconductive drum detecting circuit is transmitted, the controller updates the total number-of-sheets data at that time as the replacement number-of-sheets data of the photoconductive drum unit.

10. The image forming device according to claim 3, further comprising a detecting sensor arranged to detect a replacement of the developing unit, and a developing unit detecting circuit which transmits a detection signal from the detecting sensor to the controller, wherein when the detection signal from the developing unit detecting circuit is transmitted, the controller updates the total number-of-sheets data at that time as the replacement number-of-sheets data of the developing unit.

11. A method for displaying an announcement regarding replacing a photoconductive drum unit and a developing unit, comprising the steps of:

determining whether or not usage performance data of the photoconductive drum unit is at least a predetermined number-of-sheets data of the photoconductive drum unit which indicates that the photoconductive drum unit should be replaced;

determining whether or not usage performance data of the developing unit is within a prescribed number-of-sheets of at least a predetermined number-of-sheets data of the developing unit which indicates that the developing unit should be replaced but has not yet reached the predetermined number-of-sheets data, when the usage performance data of the photoconductive drum unit is determined to be at least the predetermined number-of-sheets data of the photoconductive drum unit; and carrying out a notice display process to urge a replacement of both the photoconductive drum unit and the developing unit when the usage performance data of the developing unit is at least the predetermined number-of-sheets data of the developing unit.

12. The method according to claim 11, further comprising the steps of:

determining a total number-of-sheets data which represents a total number of sheets of paper upon which an image forming process has been executed;

determining a replacement number-of-sheets data at a replacement timing of the photoconductive drum unit; and calculating the usage performance data of the photoconductive drum unit by subtracting the replacement number-of-sheets data of the photoconductive drum unit from the total number-of-sheets data.

13. The method according to claim 12, further comprising the steps of:

determining a replacement number-of-sheets data at a replacement timing of the developing unit; and calculating the usage performance data of the developing unit by subtracting the replacement number-of-sheets data of the developing unit from the total number-of-sheets data.

14. The method according to claim 13, further comprising the steps of:

determining whether or not a notice urging a replacement of the developing unit is displayed when a determination is made that the usage performance data of the photoconductive drum unit is smaller than the predetermined number-of-sheets data of the photoconductive drum unit;

determining whether or not the usage performance data of the developing unit is at least the predetermined number-of-sheets data of the developing unit to determine whether or not the developing unit has reached the replacement timing; and carrying out a notice display process if the usage performance data of the developing unit is at least the predetermined number-of-sheets data.

15. The method according to claim 13, further comprising the steps of:

determining whether or not a notice urging a replacement of the photoconductive drum unit is displayed when the determination is made that the usage performance data of the developing unit is smaller than the prescribed number-of-sheets;

determining whether or not the usage performance data of the photoconductive drum unit is at least a warning number-of-sheets data of the photoconductive drum unit when the notice is already displayed by retrieving the warning number-of-sheets data of the photoconductive drum unit; and carrying out a warning display process if the usage performance data of the photoconductive drum unit is at least the warning number-of-sheets data.

16. The method according to claim 13, further comprising the steps of:

determining whether or not a notice urging a replacement of the photoconductive drum unit is displayed if the determination is made that the usage performance data of the developing unit is smaller than the prescribed number-of-sheets; and displaying a replacement notice display of the photoconductive drum unit if a determination is made that a notice is not displayed.

17. The method according to claim 12, further comprising the steps of:

determining whether or not a notice urging a replacement of the developing unit is displayed when a determination is made that the usage performance data of the photoconductive drum unit is smaller than the predetermined number-of-sheets data of the photoconductive drum unit;

determining whether or not the usage performance data of the developing unit is at least a warning number-of-sheets data when the notice is already displayed by retrieving the warning number-of-sheets data of the developing unit; and carrying out a warning display process if the usage performance data of the developing unit is at least the warning number-of-sheets data.

18. An image forming device comprising:

a replaceable photoconductive drum unit having a replacement timing;

a replaceable developing unit having a replacement timing; and a controller arranged to determine whether or not the photoconductive drum unit replacement timing has been reached and whether or not a replacement timing of the developing unit is within a prescribed value of the replacement timing of the developing unit but has not yet reached the replacement timing, and to provide a display urging replacement of both the photoconductive drum unit and the developing unit when the replacement timing of the developing unit is within the prescribed value but has not yet reached the replacement timing.

19. The image forming device according to claim 18, wherein the controller determines whether or not the photoconductive drum unit replacement timing has been reached and whether or not a replacement timing of the developing unit is within a prescribed value of the replacement timing of the developing unit but has not yet reached the replacement timing based on at least one of a total number-of-sheets data which represents a total number of sheets of paper on which an image forming process has been executed, a total number-of-sheets data at a time of replacement of the photoconductive drum unit, and a notice number-of-sheets data which represents a predetermined printed number-of-sheets when the photoconductive drum unit should be replaced.

20. The image forming device according to claim 18, wherein the controller includes a first determination processing unit which determines whether or not the photoconductive drum unit has reached a replacement timing, a second determination processing unit which determines a replacement timing of the developing unit in accordance with usage performance data of the developing unit, and a third determination processing unit which determines whether or not the developing unit is within a prescribed value of the replacement timing of the developing unit but has not yet reached the replacement timing of the developing unit, when the first determination processing unit determines that the replacement timing of the photoconductive drum unit has been reached.

* * * * *